US009278539B2

(12) United States Patent
Saka et al.

(10) Patent No.: US 9,278,539 B2
(45) Date of Patent: Mar. 8, 2016

(54) RECORDING APPARATUS

(71) Applicant: SEIKO EPSON CORPORATION, Tokyo (JP)

(72) Inventors: Yoshihisa Saka, Shiojiri (JP); Yuji Miyamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/814,797

(22) Filed: Jul. 31, 2015

(65) Prior Publication Data

US 2016/0031223 A1 Feb. 4, 2016

(30) Foreign Application Priority Data

Jul. 31, 2014 (JP) ..... 2014-155906

(51) Int. Cl.
*B41J 2/15* (2006.01)
*B41J 2/175* (2006.01)

(52) U.S. Cl.
CPC ..... *B41J 2/175* (2013.01)

(58) Field of Classification Search
CPC ..... B41J 2/175; B41J 2/17509; B41J 2/18; B41J 2/17513; B41J 2/17523; B41J 2/17503
See application file for complete search history.

(56) References Cited

U.S. PATENT DOCUMENTS 8,590,756 B2 * 11/2013 Baker ..... B41J 2/17513 222/464.6
8,876,269 B2 * 11/2014 Hirano ..... B41J 2/175 347/22
8,936,356 B2 * 1/2015 Yoshida ..... B41J 29/377 347/6

FOREIGN PATENT DOCUMENTS

JP 2009-202346 A 9/2009

* cited by examiner

*Primary Examiner* — Lamson Nguyen
(74) *Attorney, Agent, or Firm* — Workman Nydegger

(57) ABSTRACT

There is provided a printer including: a recording head which performs recording by ejecting ink; a recording unit which stores the recording head; a liquid storage unit which is provided outside the recording unit, and stores a liquid storage body that stores the ink to be ejected from the recording head; ink supply tubes which supply the ink that is stored in the liquid storage body stored in the liquid storage unit to the recording head; and a supporting portion which is provided in the liquid storage unit, and supports the ink supply tubes. As a mark which is a reference of a part supported by the supporting portion, a line is provided in the ink supply tubes.

19 Claims, 13 Drawing Sheets

RECORDING APPARATUS

BACKGROUND

1. Technical Field

The present invention relates to a recording apparatus, such as an ink jet type printer.

2. Related Art

In the related art, an ink jet type printer which performs printing (recording) by ejecting ink (liquid) onto a recording medium, such as a paper sheet, from a liquid ejecting head (recording head) is known as one type of a recording apparatus. In such a printer, in order to make it possible to supply the ink to the liquid ejecting head continuously and stably even when a relatively large amount of printing is performed, a configuration in which an ink bag (liquid storage body) which has a relatively large amount of storage of the ink is provided is suggested (for example, refer to JP-A-2009-202346).

In the recording apparatus described in JP-A-2009-202346, the ink bag is supported by a supporting device which is provided outside a housing, and the ink is supplied through an ink supply tube to the liquid ejecting head which is provided inside the housing from the ink bag.

However, as described above, in the recording apparatus in which the ink is supplied to the liquid ejecting head provided inside the housing from the ink bag provided outside the housing, the ink is supplied to the recording head from the ink bag through the ink supply tube. For this reason, when the ink supply tube which links the ink bag and the liquid ejecting head to each other is bent and crushed in the middle, there is a concern that a printing error, such as dot omission, is generated because a flow of the ink deteriorates, and a sufficient amount of ink cannot be supplied to the recording head.

In addition, such a problem is not limited to the recording apparatus which ejects the ink from the liquid ejecting head, but generally common to the recording apparatus which supplies the liquid via the liquid supply tube to the recording head from the liquid storage body that stores the liquid to be ejected from the recording head.

SUMMARY

An advantage of some aspects of the invention is to provide a recording apparatus which can suppress that the liquid supply tube that links the liquid storage body and the recording head to each other is bent and crushed.

According to a first aspect of the invention, there is provided a recording apparatus including: a recording head which performs recording by ejecting liquid onto a recording medium; a recording unit which stores the recording head; a storage unit which is provided outside the recording unit, and stores a liquid storage body that stores the liquid to be ejected from the recording head; a liquid supply tube which supplies the liquid that is stored in the liquid storage body stored in the storage unit to the recording head; and a supporting portion which is provided in at least one of the recording unit and the storage unit, and supports the liquid supply tube. A mark which is a reference of a part supported by the supporting portion is provided in the liquid supply tube.

According to a second aspect of the invention, there is provided a recording apparatus including: a recording head which performs recording by ejecting liquid onto a recording medium; a recording unit which stores the recording head; a storage unit which stores a liquid storage body that stores the liquid to be ejected from the recording head; a liquid supply tube which supplies the liquid that is stored in the liquid storage body stored in the storage unit to the recording head; and a supporting portion which is provided in at least one of the recording unit and the storage unit, and supports the liquid supply tube. A mark which is a reference of a part supported by the supporting portion is provided in the liquid supply tube.

According to the above-described configuration, since the liquid supply tube is supported by the supporting portion, it is possible to suppress that the liquid supply tube is bent and crushed.

However, only by providing the supporting portion, there is a concern that the liquid supply tubes are arranged in a state of being bent and crushed from the beginning, and supported by the supporting portion as in such a bent and crushed state.

Meanwhile, in the above-described configuration, the mark which is a reference of the part supported by the supporting portion is provided in the liquid supply tube. For this reason, by matching the position where the liquid supply tube is supported by the supporting portion with the mark which is a reference, it is possible to support the liquid supply tube at an appropriate part not making the liquid supply tube bent and crushed. Therefore, according to the above-described configuration, it is possible to suppress that the liquid supply tubes are arranged in a state of being bent and crushed from the beginning.

In short, according to the above-described configuration, it is possible to suppress that the liquid supply tube is bent and crushed, by appropriately supporting the liquid supply tube. Furthermore, it is possible to suppress that a flow of the liquid in the liquid supply tube deteriorates and a printing error or the like is generated.

In the recording apparatus described above, it is preferable that the supporting portion includes a guide groove which stores the liquid supply tube. It is preferable that, in the guide groove, an outer circumferential wall on the outside of a curved portion on a curved part is provided continuously across the entire length of the curved portion of the guide groove.

According to the above-described configuration, the liquid supply tube is regulated not to be projected to an outer circumferential side by the outer circumferential wall. For this reason, it is possible to adjust a degree of curvature of the liquid supply tube by the guide groove, and to further suppress that the liquid supply tube is bent and crushed.

In the recording apparatus described above, it is preferable that in the guide groove, an inner circumferential wall on the inside of the curved portion on a curved part is provided intermittently. It is preferable that, at a part where the inner circumferential wall in the guide groove is cut out, a protruding portion which protrudes toward the inside of the curved portion from the outer circumferential wall, and presses the liquid supply tube stored in the guide groove is provided.

According to the above-described configuration, the liquid supply tube which is stored in the guide groove is pressed by the protruding portion. For this reason, the liquid supply tube is unlikely to be detached from the guide groove. In addition, since the inner circumferential wall is cut out at the position where the protruding portion is provided, it is possible to assemble the liquid supply tube to the guide groove through this cut-out part even when the protruding portion is provided.

In the recording apparatus described above, it is preferable that a supporting mechanism to which the liquid storage body is attached is fixed in the storage unit. It is preferable that, in the supporting mechanism, a liquid supply needle which is inserted into the liquid storage body and makes the liquid storage body and the liquid supply tube communicate with each other when the liquid storage body is attached is provided. It is preferable that, as the supporting portion, while a first supporting portion is provided at a part where the liquid supply tube is drawn out from the supporting mechanism in the storage unit, a second supporting portion is provided at a position which is separated from the first supporting portion in the case. In addition, it is preferable that one pair of side walls are respectively provided in the first supporting portion and the second supporting portion, a distance between the one pair of side walls in the first supporting portion is longer than a diameter of the liquid supply tube, and a distance between the one pair of side walls in the second supporting portion is shorter than the diameter of the liquid supply tube.

An insertion portion which inserts the liquid supply needle is provided in the liquid storage body. However, since the liquid storage body has irregularity in the dimension because of manufacturing tolerance or the like, when attaching the liquid storage body to the supporting mechanism, it is preferable to adjust the position of the liquid supply needle, and to perform positioning of the liquid supply needle and the insertion portion of the liquid storage body.

According to the above-described configuration, since the liquid supply tube is fixed by the second supporting portion, it is possible to suppress that the liquid supply tube is bent and crushed in the storage unit. In addition, since the liquid supply tube is supported to be displaceable by the first supporting portion, it is possible to allow displacement of the liquid supply needle, and to adjust the position of the insertion portion and the liquid supply needle when attaching the liquid storage body to the supporting mechanism.

In addition, in the above-described recording apparatus, at the part where the supporting portion is provided in the storage unit, when the mark which becomes a pair with the mark provided in the liquid supply tube is provided, by matching the positions of the marks which become a pair with each other, it is possible to more precisely position the liquid supply tube.

Furthermore, in the configuration, when the mark which is provided in the storage unit is expressed by the concave/convex part provided on the wall surface of the storage unit, since it is possible to engrave the mark in a process of forming the storage unit, it is possible to reduce the number of manufacturing processes compared to a case where the mark is provided after forming the storage unit.

In the recording apparatus described above, at a part where the supporting portion in the storage unit is provided, a mark which becomes a pair with the mark provided in the liquid supply tube may be provided.

In this configuration, it is also possible to more precisely position the liquid supply tube by matching the positions of the marks which become a pair with each other.

In addition, when the mark which is provided in the recording unit is expressed by the concave/convex part provided on the wall surface of the recording unit, since it is possible to engrave the mark in a process of forming the recording unit, it is possible to reduce the number of manufacturing processes compared to a case where the mark is provided after forming the recording unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the recording apparatus will be described with reference to FIGS. 1 to 13. In addition, the embodiment illustrates an example in which the recording apparatus is specified as an ink jet type printer (hereinafter, simply referred to as a "printer").

Figure 1:
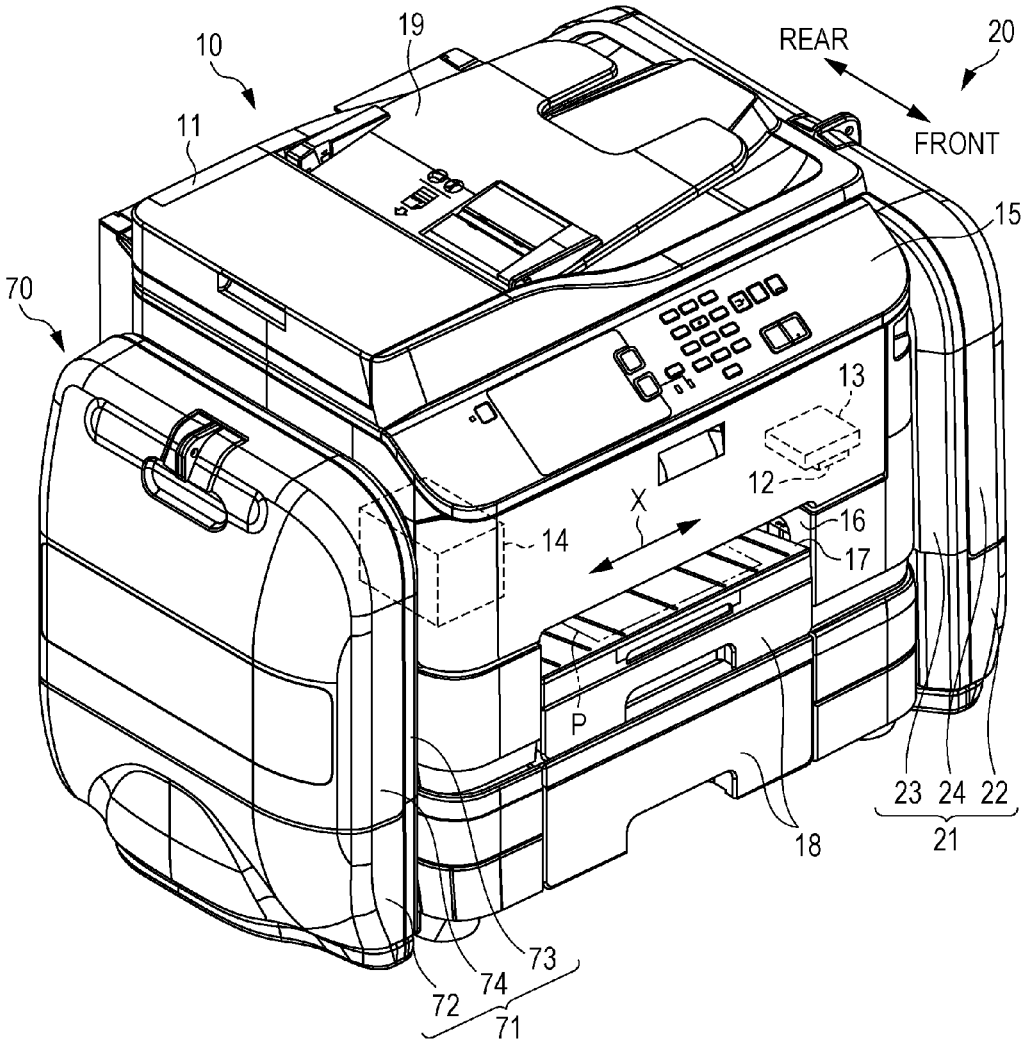
FIG. 1 is a perspective view illustrating a recording apparatus as an embodiment.

As illustrated in FIG. 1, the printer includes a recording unit 10 which performs recording on a paper sheet P which is an example of a recording medium by ejecting ink which is an example of liquid, and two liquid storage units 20 and 70 which supply the ink to the recording unit 10. In addition, the liquid storage units 20 and 70 are storage units which store a liquid storage body 40 which will be described later.

A housing 11 is provided in the recording unit 10, and a recording head 12 which ejects the ink and performs recording on the paper sheet P, and a carriage 13 which supports the recording head 12 are stored in the housing 11.

The carriage 13 can reciprocate in a scanning direction X which is a width direction of the printer inside the housing 11, and performs recording (printing) on the paper sheet P by ejecting the ink while the recording head 12 reciprocates in the width direction of the printer according to the movement of the carriage 13.

A repeater 14 is stored in the housing 11. A buffer chamber which temporarily stores the ink to be supplied to the recording head 12 from each of the liquid storage units 20 and 70 is provided in the repeater 14. In the repeater 14, the ink is supplied to the recording head 12 by excluding the air which flows into the buffer chamber together with the ink.

In addition, in the housing 11, an operation panel 15 with which a user operates the printer is provided. In addition, as illustrated by an arrow in FIG. 1, hereinafter, a direction in which a monitor or buttons are oriented in the operation panel 15 is a forward direction of the printer, and a direction opposite to the forward direction is rearward direction.

On a front surface which is positioned on a front side of the printer in the housing 11, a rectangular discharge port 16 which discharges the recorded paper sheet P to the outside of the housing 11 is provided inside the housing 11. The paper sheet P which is discharged from the discharge port 16 is mounted on a paper discharge tray 17. In addition, below the paper discharge tray 17 on the front surface of the housing 11, two upper and lower paper supply cassettes 18 are installed to be attachable and detachable. In these paper supply cassettes 18, it is possible to store a plurality of paper sheets P in a stacked state.

In addition, above the housing 11 of the recording unit 10, a scanner portion 19 which stores a scanner that reads an image recorded on a document set at a predetermined reading position is provided.

Next, with reference to FIG. 2, the liquid storage body 40 which is stored in the liquid storage units 20 and 70 will be described.

Figure 2:
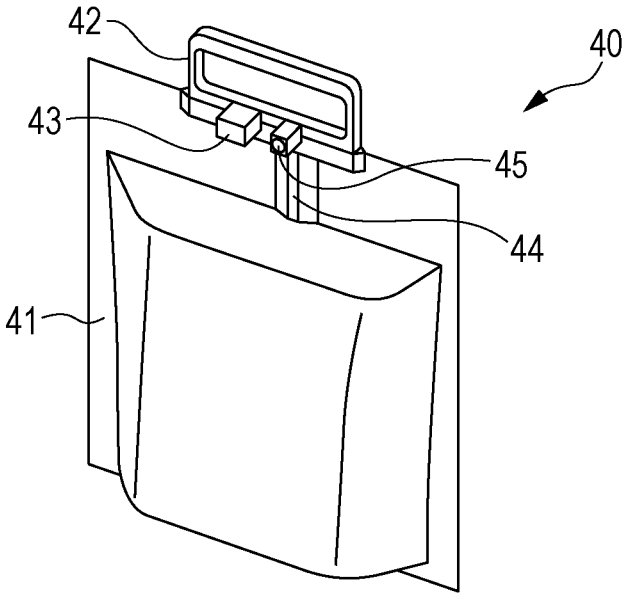
FIG. 2 is a schematic perspective view illustrating a liquid storage body which is used in the recording apparatus.

As illustrated in FIG. 2, the liquid storage body 40 includes an ink bag 41 which is made of a flexible material, and the ink is stored in the ink bag 41. In addition, a rectangular ring-shaped handle portion 42 is fixed to an upper end portion of the ink bag 41. In a connection portion between the ink bag 41 and the handle portion 42, an IC chip 43 is provided. In the IC chip 43, a residual amount or a type of the ink which is stored in the ink bag 41 is stored. In addition, in the connection portion between the ink bag 41 and the handle portion 42, an insertion portion 45 which is covered with a filter or the like, and communicates with the inside of the ink bag 41 through a supply path 44 is provided.

Next, with reference to FIGS. 3 to 5, a first liquid storage unit 20 which is attached to a right surface of the housing 11 will be described.

Figure 3:
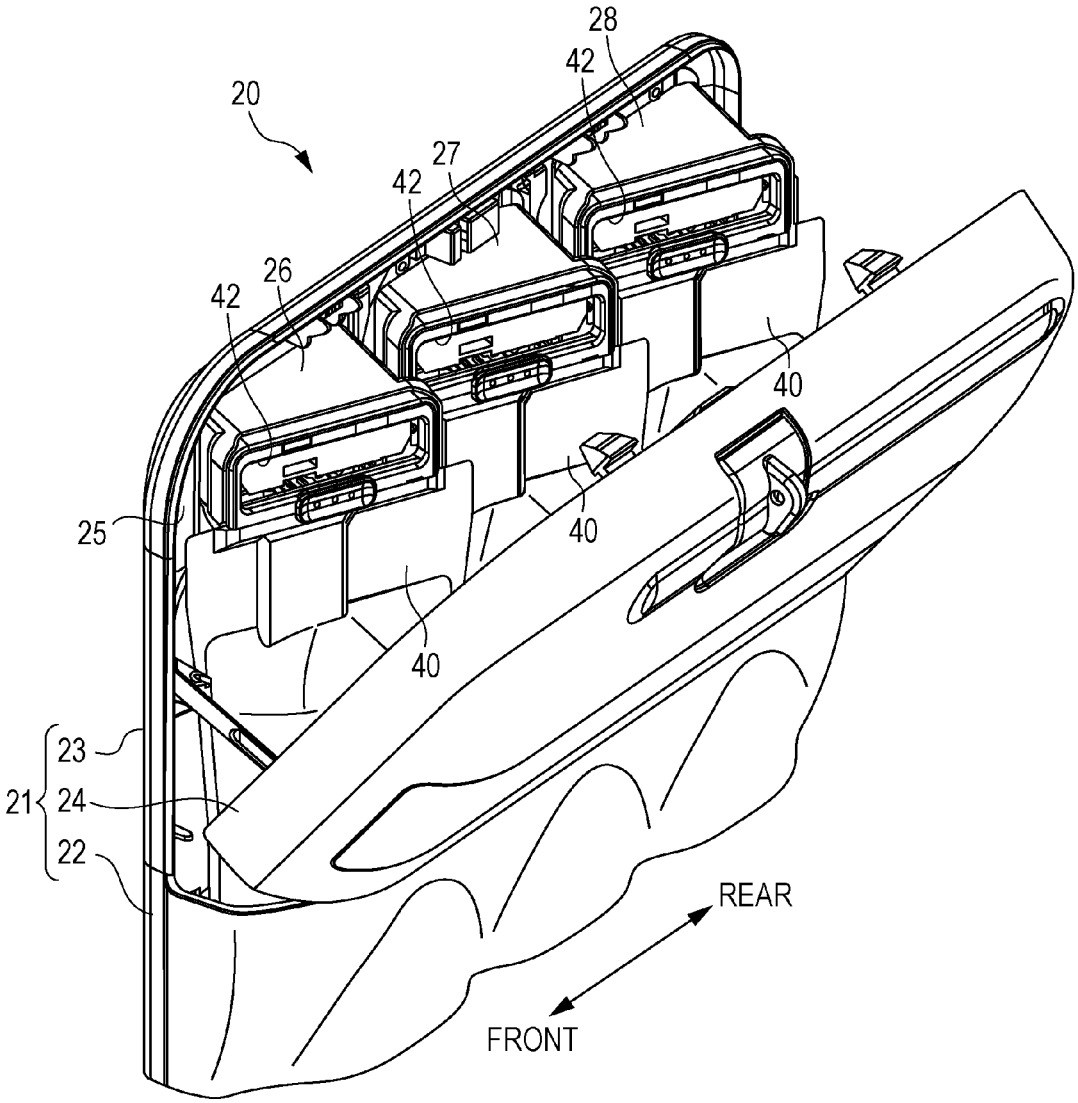
FIG. 3 is a perspective view illustrating a first liquid storage unit in a state where a lid is opened.

As illustrated in FIG. 3, the first liquid storage unit 20 includes a case 21, and stays 26, 27, and 28 which support three liquid storage bodies 40 stored in the case 21. The case 21 is configured of a bottom forming member 22 which has a shape of a bottomed box that forms a bottom of the case 21, a side wall forming member 23 which is linked to an upper end of a side wall which opposes the housing 11 in the bottom forming member 22, and a lid 24 which is linked to the upper end of the bottom forming member 22 to be rotatable. The lid 24 opens and closes the case 21 by being abutted against and separated from the upper end of the side wall forming member 23. In addition, the case 21 is formed in a shape of a substantially rectangular parallelepiped.

In the case 21, the three stays 26, 27, and 28 which protrude from a wall surface 25 of the side wall forming member 23 are provided. The liquid storage body 40 is attachable and detachable as the handle portion 42 of the liquid storage body 40 is fitted to each of the stays 26, 27, and 28. In other words, the stays 26, 27, and 28 function as a supporting mechanism which supports the liquid storage body 40. In addition, the liquid storage body 40 which stores, for example, yellow ink, is attached to the stay 26, the liquid storage body 40 which stores, for example, magenta ink, is attached to the stay 27, and the liquid storage body 40 which stores, for example, cyan ink, is attached to the stay 28.

Figure 4:
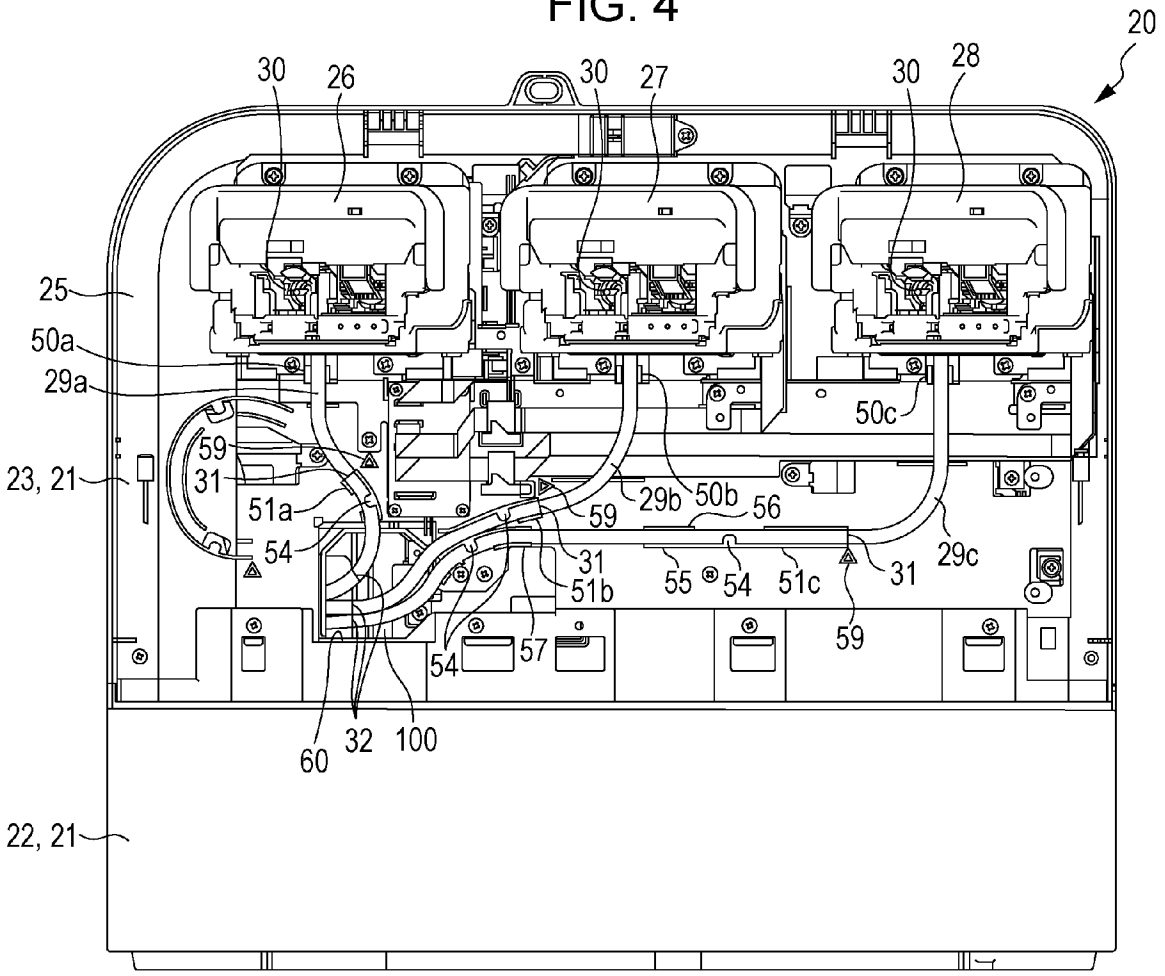
FIG. 4 is a side view of the first liquid storage unit in a state where the lid and a cover are detached.

As illustrated in FIG. 4, ink supply tubes 29*a*, 29*b*, and 29*c* are connected to below each of the stays 26, 27, and 28. One end of each of the ink supply tubes 29*a*, 29*b*, and 29*c* are connected to liquid supply needles 30 which are respectively provided inside the stays 26, 27, and 28. Each of the liquid supply needles 30 is provided to be displaceable inside the stays 26, 27, and 28, and tip ends thereof are exposed. Accordingly, when the liquid storage bodies 40 are assembled to each of the stays 26, 27, and 28, the liquid supply needle 30 spears the insertion portion 45 which is provided in the liquid storage body 40, and the liquid supply needle 30 is inserted into the liquid storage body 40. Accordingly, the ink supply tubes 29*a*, 29*b*, and 29*c* which are connected to the liquid supply needles 30, and the liquid storage bodies 40, communicate with each other.

In each of the ink supply tubes 29*a*, 29*b*, and 29*c*, three lines are provided being apart at an interval in an extending direction of the ink supply tubes 29*a*, 29*b*, and 29*c*, as the marks. These lines extend continuously across the entire circumference in a circumferential direction which is a direction orthogonal to the extending direction of the ink supply tubes 29*a*, 29*b*, and 29*c*, and have a circular shape. In addition, hereinafter, among the three lines which are provided in each of the ink supply tubes 29*a*, 29*b*, and 29*c*, a line which is provided at a position closest to one end connected to the stays 26, 27, and 28 is a first line 31, and a line which is provided at a position farthest from the end portion connected to the stays 26, 27, and 28 is a third line 33. In addition, among the three lines which are provided in each of the ink supply tubes 29*a*, 29*b*, and 29*c*, a line between the first line 31 and the third line 33 is a second line 32.

In addition, the ink supply tubes 29*a*, 29*b*, and 29*c* are respectively supported in a curved shape by a plurality of supporting portions which are provided on the wall surface 25 of the side wall forming member 23, that is, a plurality of supporting portions which are provided in the first liquid storage unit 20. In addition, a cover which hides the ink supply tubes 29*a*, 29*b*, and 29*c* that are drawn into the case 21 is attached to the inside of the case 21, but FIG. 4 illustrates a state where the cover, the lid 24, and the liquid storage body 40 are detached.

Next, a configuration of each supporting portion which is provided on the wall surface 25 of the side wall forming member 23 will be described.

On the wall surface 25 of the side wall forming member 23, at a part where the ink supply tubes 29*a*, 29*b*, and 29*c* are drawn out from the stays 26, 27, and 28, that is, a part immediately below the stays 26, 27, and 28, first supporting portions 50*a*, 50*b*, and 50*c* which have one pair of side walls that stand from the wall surface 25 are provided. One pair of side walls in the first supporting portions 50*a*, 50*b*, and 50*c* extend in a vertical direction in FIG. 4, and a distance between the side walls is longer than diameters of the ink supply tubes 29*a*, 29*b*, and 29*c*. For this reason, in the first supporting portions 50*a*, 50*b*, and 50*c*, the ink supply tubes 29*a*, 29*b*, and 29*c* are displaceable in the vertical direction in FIG. 4, and are assembled in a state of extending in the vertical direction in FIG. 4.

In addition, at a position which is separated from the first supporting portions 50*a*, 50*b*, and 50*c*, second supporting portions 51*a*, 51*b*, and 51*c* are provided. The second supporting portions 51*a*, 51*b*, and 51*c* are guide grooves, and have one pair of side walls that stand from the wall surface. Among the second supporting portions 51*a*, 51*b*, and 51*c*, the second supporting portions 51*a* and 51*b* which support the ink supply tubes 29*a* and 29*b* are curved, and the second supporting portion 51*c* which supports the ink supply tube 29*c* extend in a shape of a straight line without being curved.

Figure 5:
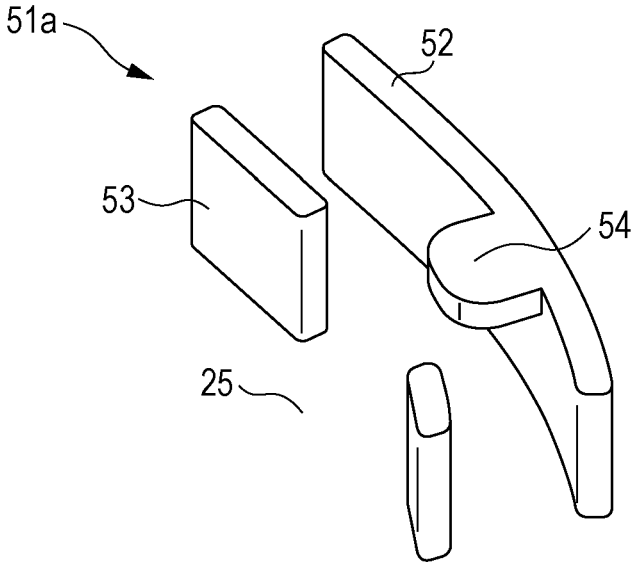
FIG. 5 is a perspective view illustrating a second supporting portion which is provided in a case of the first liquid storage unit.

As illustrated in FIG. 5, in the curved second supporting portion 51*a*, while an outer circumferential wall 52 on the outside of the curved portion is provided continuously across the entire length of the curved portion, an inner circumferential wall 53 on the inside of the curved portion is provided intermittently. In addition, at a part which is cut out by the inner circumferential wall 53, at a part which is separated the most from the wall surface 25 of the side wall forming member 23 in the outer circumferential wall 52, one protruding portion 54 which protrudes toward the inside of the curved portion, that is, the inner circumferential wall 53 side, is provided.

In addition, similarly to the second supporting portion 51*a*, in the second supporting portion 51*b*, while the outer circumferential wall 52 on the outside of the curved portion is provided continuously across the entire length of the curved portion thereof, the inner circumferential wall 53 on the inside of the curved portion is provided intermittently. In addition, at a part which is cut out by the inner circumferential wall 53, at a part which is separated the most from the wall surface 25 of the side wall forming member 23 in the outer circumferential wall 52, one protruding portion 54 which protrudes toward the inside of the curved portion is provided.

In addition, as illustrated in FIG. 4, in the second supporting portion 51*c* which is not curved, while a lower wall 55 which is positioned at a lower part in FIG. 4 is provided continuously across the entire length, an upper wall 56 which is positioned at an upper part in FIG. 4 is provided intermittently. In addition, at a part which is cut out by the upper wall 56, at a part which is separated the most from the wall surface 25 of the side wall forming member 23 in the lower wall 55, one protruding portion 54 which protrudes toward the upper wall 56 side is provided.

The distances between one pair of walls in these second supporting portions 51*a*, 51*b*, and 51*c* are shorter than the diameters of the ink supply tubes 29*a*, 29*b*, and 29*c*. In other words, the distances between the outer circumferential wall 52 and the inner circumferential wall 53 in the second supporting portions 51*a* and 51*b* are shorter than the diameters of the ink supply tubes 29*a* and 29*b*. In addition, the distance between the lower wall 55 and the upper wall 56 in the second supporting portion 51*c* is shorter than the diameter of the ink supply tube 29*c*. For this reason, in the second supporting portions 51*a*, 51*b*, and 51*c*, the ink supply tubes 29*a*, 29*b*, and 29*c* which are assembled to the second supporting portions 51*a*, 51*b*, and 51*c* are fixed along the shapes of the second supporting portions 51*a*, 51*b*, and 51*c*.

In addition, below the second supporting portion 51*b*, a third supporting portion 57 which supports the ink supply tube 29*c* is provided. The third supporting portion 57 is a curved guide groove, and has one pair of curved side walls. In addition, similarly to the second supporting portions 51*a* and 51*b*, in the third supporting portion 57, while an outer circumferential wall on the outside of the curved portion is provided continuously across the entire length of the curved portion, an inner circumferential wall on the inside of the curved portion is provided intermittently. In addition, at a part which is cut out by the inner circumferential wall, at a part which is separated the most from the wall surface 25 of the side wall forming member 23 in the outer circumferential wall, the protruding portion 54 which protrudes toward the inside of the curved portion is provided. In addition, one protruding portion 54 is provided in the third supporting portion 57. In addition, the distance between one pair of side walls in the third supporting portion 57 is shorter than the diameter of the ink supply tube 29*c*. For this reason, when the ink supply tube 29*c* is assembled to the third supporting portion 57, the ink supply tube 29*c* is fixed along the third supporting portion 57.

In this manner, the ink supply tube 29*a* which is connected to the stay 26 is supported by the first supporting portion 50*a* and the second supporting portion 51*a*. In addition, the ink supply tube 29*b* which is connected to the stay 27 is supported by the first supporting portion 50*b* and the second supporting portion 51*b*. In addition, the ink supply tube 29*c* which is connected to the stay 28 is supported by the first supporting portion 50*c*, the second supporting portion 51*c*, and the third supporting portion 57.

Here, in the side wall forming member 23, a plurality of triangular marks 59 which are expressed by convex portions are engraved on the wall surface 25. Tip ends of angles of the marks 59 are arranged to point one end of the second supporting portions 51*a*, 51*b*, and 51*c*. In addition, since the marks 59 are engraved by the convex portions on the wall surface 25, concave/convex portions which are provided on the wall surface 25 express the mark 59.

Each of the ink supply tubes 29*a*, 29*b*, and 29*c* is arranged so that the first lines 31 which are provided in the ink supply tubes 29*a*, 29*b*, and 29*c* are positioned at one end of the second supporting portions 51*a*, 51*b*, and 51*c*. In other words, each of the ink supply tubes 29*a*, 29*b*, and 29*c* are arranged so that the first line 31 in the ink supply tubes 29*a*, 29*b*, and 29*c* is positioned at substantially the same position as the position which is indicated by the triangular mark 59 provided in the case 21.

The ink supply tubes 29*a*, 29*b*, and 29*c* which are supported in this manner are drawn to the outside of the case 21 through a tube insertion hole 60 which is provided in the side wall forming member 23.

In addition, the ink supply tubes 29*a*, 29*b*, and 29*c* which are drawn to the outside of the case 21, are introduced to the inside of the housing 11 of the recording unit 10, and are connected to the repeater 14. The repeater 14 is connected to the recording head 12 through an ink supply system which is provided in the recording unit 10. For this reason, when the liquid storage bodies 40 are attached to each of the stays 26, 27, and 28 provided in the first liquid storage unit 20, the ink which is stored in the liquid storage body 40 can be supplied to the recording head 12 via the repeater 14.

Next, with reference to FIGS. 1 to 6, the second liquid storage unit 70 which is attached to a left surface of the housing 11 will be described.

As illustrated in FIG. 1, similarly to the first liquid storage unit 20, the second liquid storage unit 70 is provided with a case 71. The case 71 is configured of a bottom forming member 72 which has a shape of a bottomed box that forms a bottom of the case 71, a side wall forming member 73 which is linked to an upper end of a side wall which opposes the housing 11 in the bottom forming member 72, and a lid 74 which is linked to the upper end of the bottom forming member 72 to be rotatable. The lid 74 opens and closes the case 71 by being abutted against and separated from the upper end of the side wall forming member 73. In addition, the case 71 is formed in a shape of a substantially rectangular parallelepiped.

One liquid storage body 40 is stored in the case 71. In the liquid storage body 40, for example, black ink is stored, and the ink bag 41 which is made of a flexible material that has a larger amount than that of the liquid storage body 40 provided in the first liquid storage unit 20, and the rectangular ring-shaped handle portion 42 which is fixed to the upper end portion of the ink bag 41 are provided.

Figure 6:
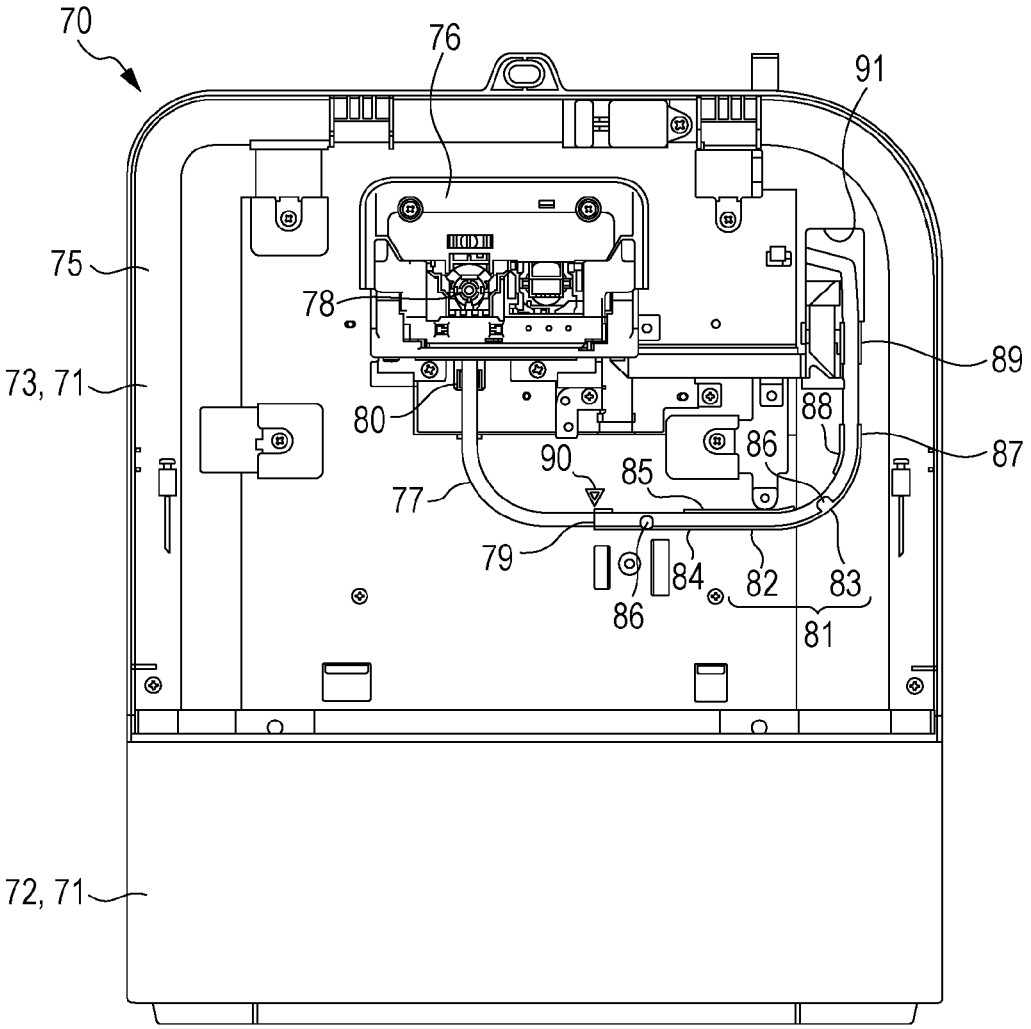
FIG. 6 is a side view of a second liquid storage unit in a state where the lid and the cover are detached.

As illustrated in FIG. 6, in the case 71, one stay 76 which protrudes from a wall surface 75 of the side wall forming member 73 is provided. The liquid storage body 40 is attachable and detachable as the handle portion 42 of the liquid storage body 40 is fitted to the stay 76. In other words, the stay 76 functions as the supporting mechanism which supports the liquid storage body 40.

An ink supply tube 77 is connected to below the stay 76. The ink supply tube 77 is connected to a liquid supply needle 78 which is provided inside the stay 76. The liquid supply needle 78 is provided to be displaceable inside the stay 76, and tip end thereof is exposed. Accordingly, when the liquid storage body 40 is assembled to the stay 76, the liquid supply needle 78 spears the insertion portion 45 which is provided in the liquid storage body 40, and the liquid supply needle 78 is inserted into the liquid storage body 40. Accordingly, the ink supply tube 77 which is connected to the liquid supply needle 78, and the liquid storage body 40, communicate with each other.

In the ink supply tube 77, as a mark, one line 79 is provided. The line 79 extends continuously across the entire circumference in the circumferential direction which is a direction orthogonal to the extending direction of the ink supply tube 77, and has a circular shape.

The ink supply tube 77 is supported in a curved shape by the plurality of supporting portions which are provided on the wall surface 75 of the side wall forming member 73, that is, the plurality of supporting portions which are provided in the second liquid storage unit 70. In addition, a cover which hides the ink supply tube 77 that is drawn into the case 71 is attached to the inside of the case 71, but FIG. 6 illustrates a state where the cover, the lid 74, and the liquid storage body 40 are detached.

Next, a configuration of each supporting portion which is provided on the wall surface 75 of the side wall forming member 73 will be described.

On the wall surface 75 of the side wall forming member 73, at a part where the ink supply tube 77 is drawn out from the stay 76, that is, a part immediately below the stay 76, a first supporting portion 80 which has one pair of side walls that stand from the wall surface 75 is provided. One pair of side walls in the first supporting portion 80, extend in a vertical direction in FIG. 6, and a distance between the side walls is longer than diameters of the ink supply tube 77. For this reason, in the first supporting portion 80, the ink supply tube 77 is displaceable in the vertical direction in FIG. 6, and is assembled in a state of extending in the vertical direction in FIG. 6.

In addition, at a position which is separated from the first supporting portion 80, a second supporting portion 81 is provided. The second supporting portion 81 is a guide groove, and has one pair of side walls that stand from the wall surface. The second supporting portion 81 is provided with a straight line portion 82 which extends in a shape of a straight line in a horizontal direction in FIG. 6, and a curved portion 83 which is curved by 90° upward from the straight line portion 82.

In the straight line portion 82, while a lower wall 84 which is positioned at a lower part in FIG. 6 is provided continuously across the entire length, an upper wall 85 which is positioned at an upper part in FIG. 6 is provided intermittently. In addition, at a part which is cut out by the upper wall 85, at a part which is separated the most from the wall surface 75 of the side wall forming member 73 in the lower wall 84, one protruding portion 86 which protrudes toward the upper wall 85 side is provided.

Figure 7:
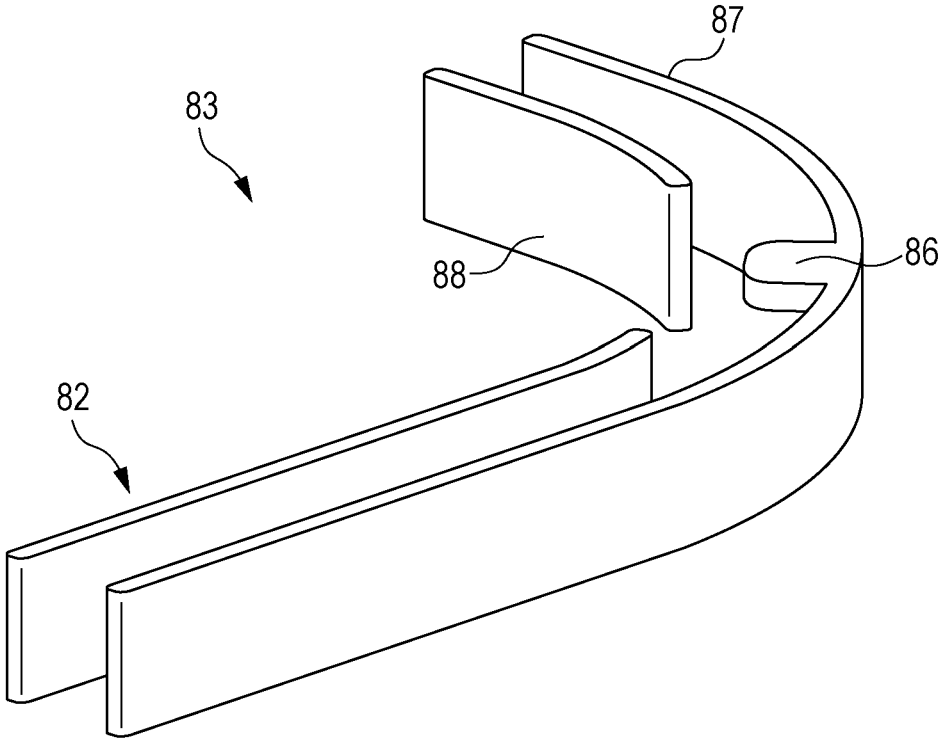
FIG. 7 is a perspective view illustrating the second supporting portion which is provided in a case of the second liquid storage unit.

In addition, as illustrated in FIGS. 6 and 7, in the curved portion 83, while an outer circumferential wall 87 on the outside of the curved portion 83 is provided continuously across the entire length of the curved portion 83, an inner circumferential wall 88 on the inside of the curved portion 83 is provided intermittently. In addition, at a part which is cut out by the inner circumferential wall 88, at a part which is separated the most from the wall surface 75 of the side wall forming member 73 in the outer circumferential wall 87, one protruding portion 86 which protrudes toward the inner side of the curved portion 83, that is, the inner circumferential wall 88 side, is provided.

A distance between one pair of walls in the second supporting portion 81 is shorter than a diameter of the ink supply tube 77. In other words, a distance between the lower wall 84 and the upper wall 85 in the straight line portion 82 is shorter than the diameter of the ink supply tube 77. In addition, a distance between the outer circumferential wall 87 and the inner circumferential wall 88 in the curved portion 83 is also shorter than the diameter of the ink supply tube 77. For this reason, in the second supporting portion 81, the ink supply tube 77 which is assembled to the second supporting portion 81 is fixed along the shape of the second supporting portion 81.

In addition, above the curved portion 83 of the second supporting portion 81, a third supporting portion 89 which has one pair of side walls that stand from the wall surface 75 of the side wall forming member 73 is provided. The one pair of side walls in the third supporting portion 89 extend in the vertical direction in FIG. 6, and a distance between the side walls is shorter than the diameter of the ink supply tube 77. For this reason, in the third supporting portion 89, the ink supply tube 77 is fixed in a state of extending in the vertical direction in FIG. 6.

Here, in the side wall forming member 73, a triangular mark 90 which is expressed by a convex portion is engraved on the wall surface 75. A tip end of an angle of the mark 90 is arranged to point one end of the second supporting portion 81. In addition, since the mark 90 is engraved by a convex portion on the wall surface 75, concave/convex portions which are provided on the wall surface 75 express the mark 90.

The ink supply tube 77 is supported by the first supporting portion 80, the second supporting portion 81, and the third supporting portion 89 so that the line 79 which is provided in the ink supply tube 77 is positioned at one end of the second supporting portion 81. In other words, the position of the line 79 in the ink supply tube 77 is arranged to be substantially the same as the position indicated by the triangular mark 90 provided in the case 71.

The ink supply tube 77 which is supported in this manner is drawn to the outside of the case 71 through a tube insertion hole 91 which is provided in the side wall forming member 73.

In addition, the ink supply tube 77 which is drawn to the outside of the case 71, is introduced to the inside of the housing 11 of the recording unit 10, and is connected to the repeater 14. Accordingly, when the liquid storage body 40 is attached to the stay 76 provided in the second liquid storage unit 70, the ink which is stored in the liquid storage body 40 can be supplied to the recording head 12 via the repeater 14.

Next, with reference to FIGS. 8 to 13, a state of arrangement of the ink supply tubes 29*a*, 29*b*, 29*c*, and 77 inside the recording unit 10 will be described.

Figure 8:
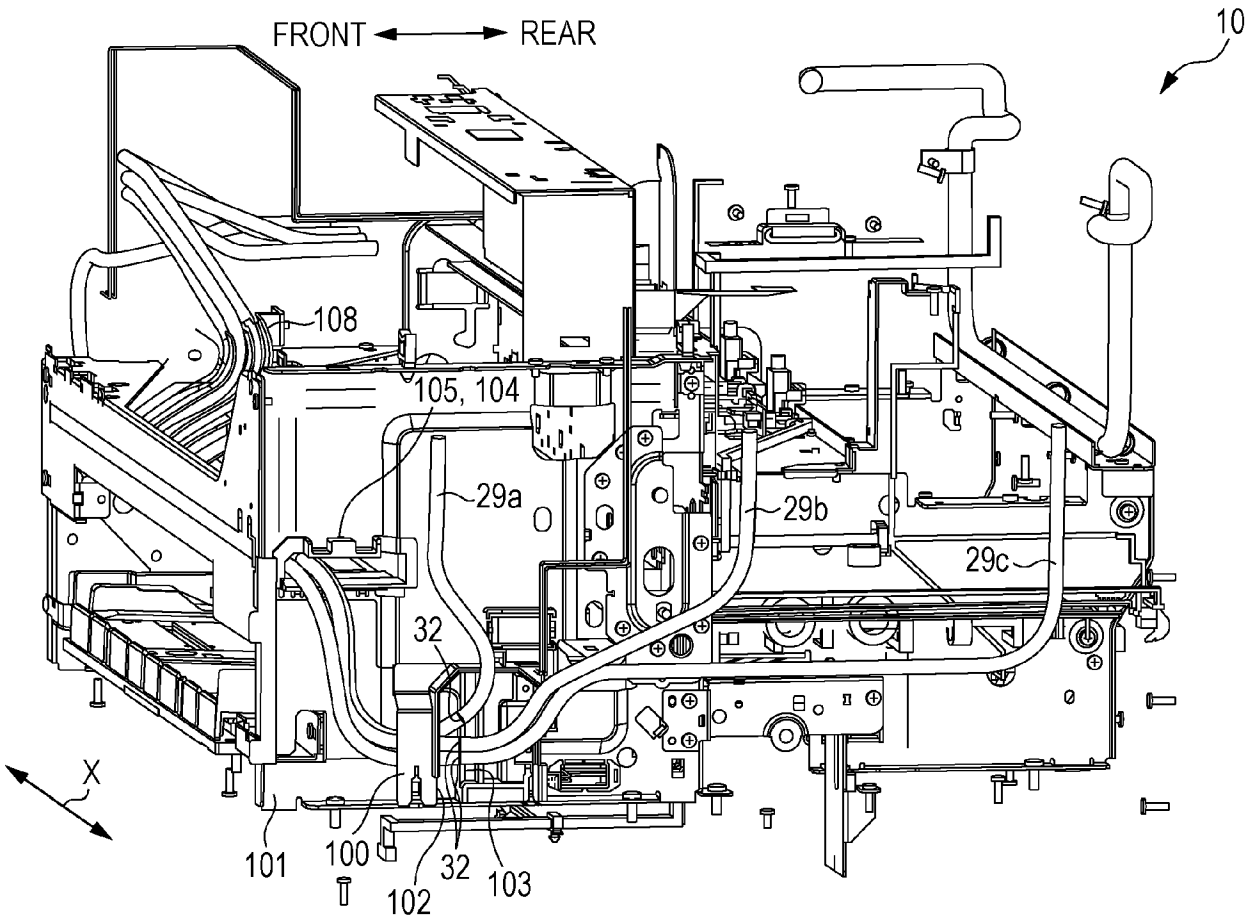
FIG. 8 is a perspective view illustrating a state where liquid supply tubes are arranged.

In FIG. 8, the recording unit 10 in a state where a part of the housing 11 is detached is illustrated.

As illustrated in FIG. 8, in the housing 11, a tunnel member 100 is provided. The tunnel member 100 has a shape of a reverse U of which a lower end is opened, and the lower end thereof sticks into a main body frame 101 which constitutes a part of the housing 11. In the tunnel member 100, a through hole 102 which extends in the vertical direction is formed. The ink supply tubes 29*a*, 29*b*, and 29*c* are inserted into the through hole 102. The width of the through hole 102 is only slightly wider than the diameter of the ink supply tubes 29*a*, 29*b*, and 29*c*. For this reason, when the ink supply tubes 29*a*, 29*b*, and 29*c* are inserted into the tunnel member 100, each of the ink supply tubes 29*a*, 29*b*, and 29*c* is supported in a state of being aligned in a longitudinal direction. In other words, the tunnel member 100 functions as the supporting portion which supports the ink supply tubes 29*a*, 29*b*, and 29*c*. In the tunnel member 100, a rib 103 which extends in the vertical direction is formed. The ink supply tubes 29*a*, 29*b*, and 29*c* are arranged so that the second line 32 which is provided in the ink supply tubes 29*a*, 29*b*, and 29*c* overlaps with the rib 103.

In addition, as illustrated in FIG. 4, the tunnel member 100 is provided at a position which is exposed to the inside of the case 21 from the tube insertion hole 60 when the case 21 of the first liquid storage unit 20 is attached thereto.

Figure 9:
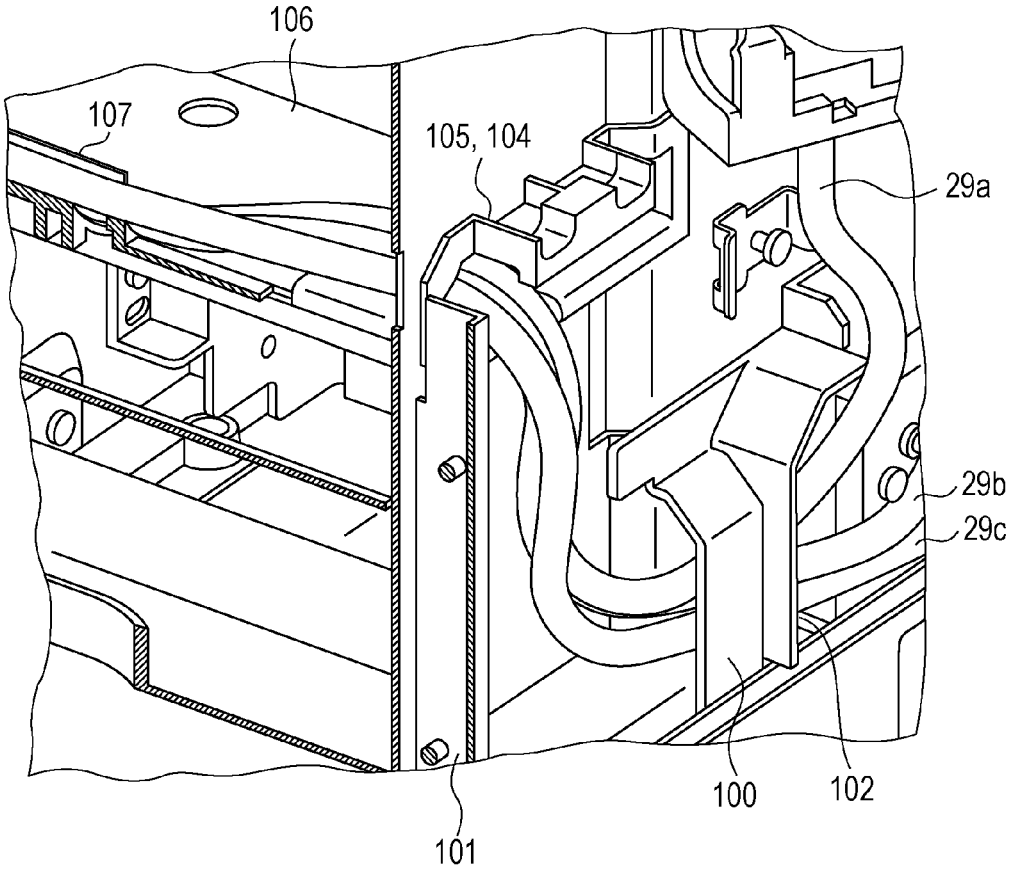
FIG. 9 is a perspective view illustrating a state where the liquid supply tubes are arranged inside a recording unit.

In addition, as illustrated in FIGS. 8 and 9, in the main body frame 101, an opening 104 for drawing the ink supply tubes 29*a*, 29*b*, and 29*c* toward the repeater 14 is provided. A protection member 105 which suppresses that the ink supply tubes 29*a*, 29*b*, and 29*c* are rubbed with an end portion of the opening 104 by covering the end portion of the opening 104, is fitted to the opening 104. In addition, in the main body frame 101, a board portion 106 which is connected to the opening 104 and extends along the scanning direction X is formed.

Figure 10:
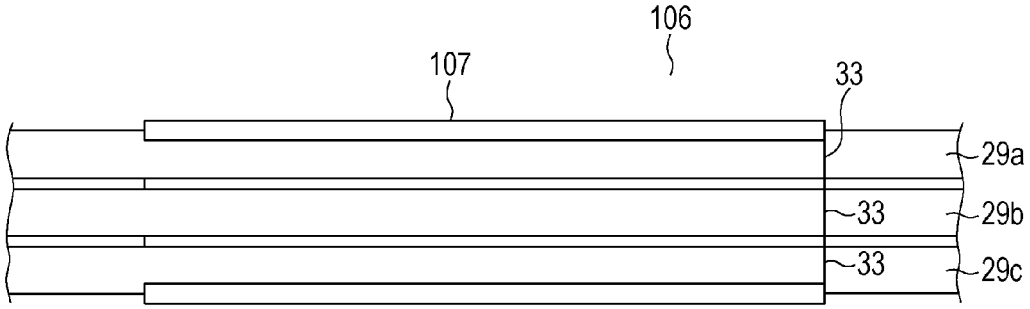
FIG. 10 is a schematic view illustrating a state where the liquid supply tubes which cross the inside the recording unit are arranged.

In addition, as illustrated in FIG. 10, in the board portion 106, a parallel supporting portion 107 which extends along the scanning direction X and supports each of the ink supply tubes 29*a*, 29*b*, and 29*c* in a state where the ink supply tubes 29*a*, 29*b*, and 29*c* are aligned in a shape of a straight line is provided. The parallel supporting portion 107 has three half-cylindrical fitting portions. The ink supply tubes 29*a*, 29*b*, and 29*c* are arranged so that the third line 33 which is provided in the ink supply tubes 29*a*, 29*b*, and 29*c* is positioned at one end of the parallel supporting portion 107.

In this manner, the ink supply tubes 29*a*, 29*b*, and 29*c* are arranged in the scanning direction X in a state of being fixed to the parallel supporting portion 107, and crosses the main body frame 101 after being drawn into the main body frame 101 from the protection member 105 (opening 104).

Figure 11:
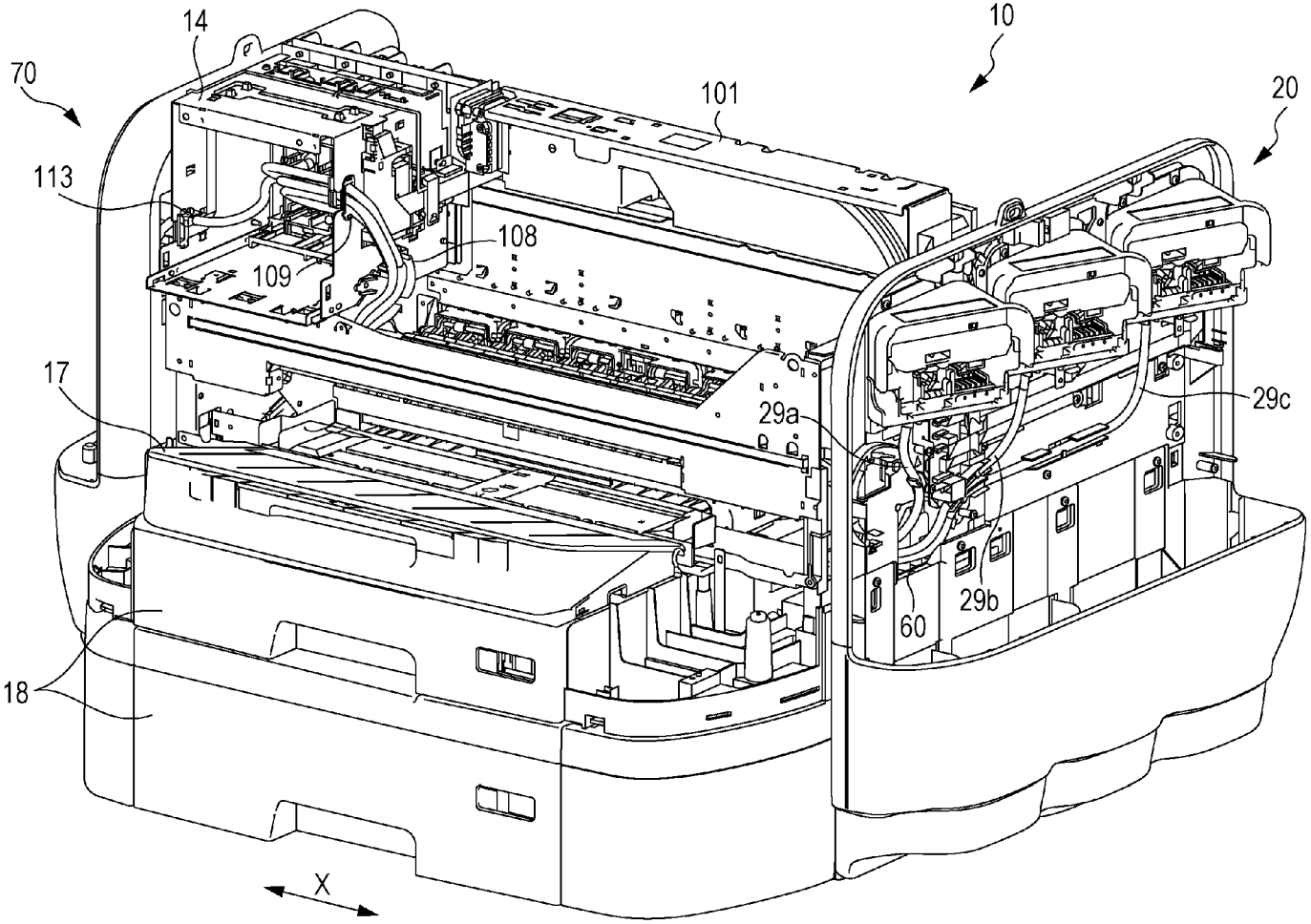
FIG. 11 is a perspective view illustrating an inner structure of the recording apparatus.

In addition, as illustrated in FIG. 11, on the further inner side (right side in FIG. 11) than the repeater 14 in the scanning direction X, a curved auxiliary member 108 for making the ink supply tubes 29*a*, 29*b*, and 29*c* curved upward is provided.

Figure 12:
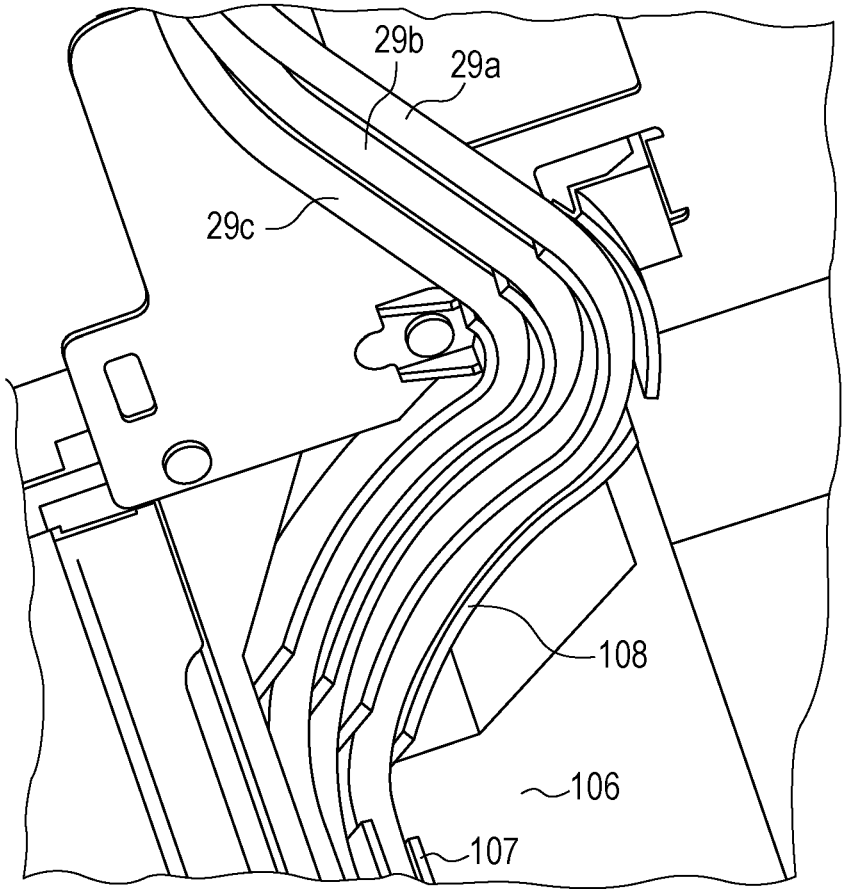
FIG. 12 is a perspective view of a supporting portion which guides the liquid supply tube to a repeater inside the recording unit.

As illustrated in FIG. 12, in the curved auxiliary member 108, the ink supply tubes 29*a*, 29*b*, and 29*c* are wound to have a spiral shape around an axial line which extends in the vertical direction.

In addition, as illustrated in FIG. 11, the ink supply tubes 29*a*, 29*b*, and 29*c* which are guided upward by the curved auxiliary member 108 are guided to the inside of the repeater 14 from a first inlet 109 of the repeater 14.

Figure 13:
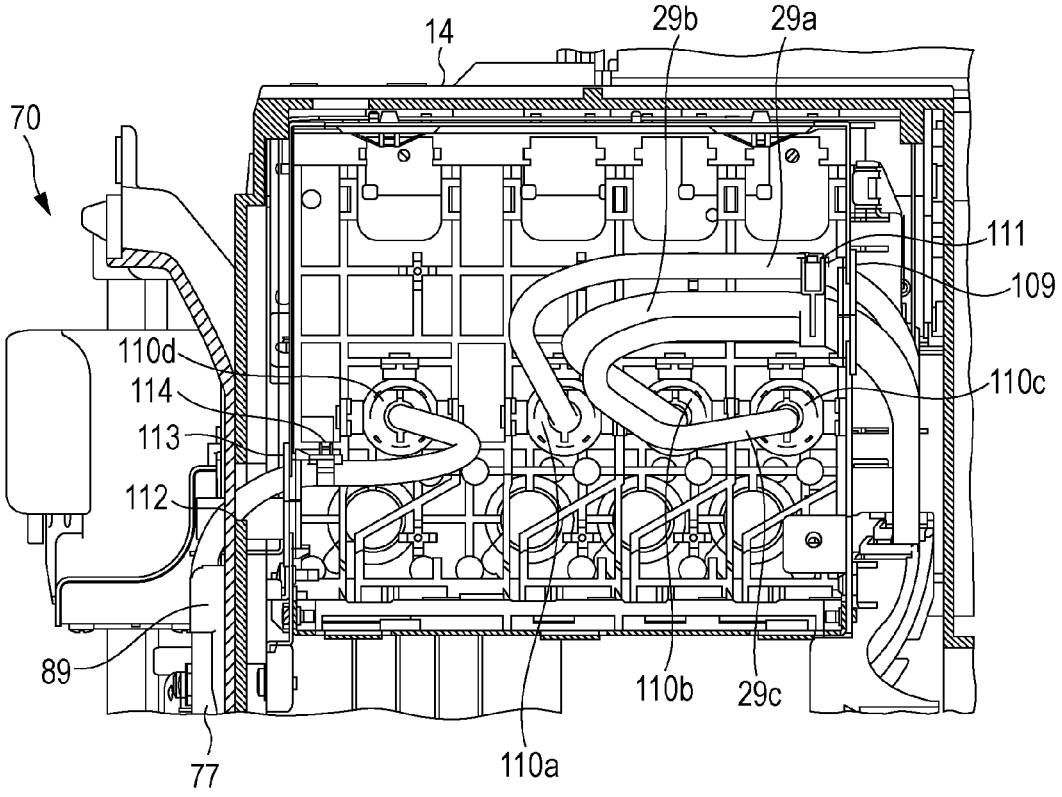
FIG. 13 is a sectional view illustrating the liquid supply tube which is connected to the repeater.

As illustrated in FIG. 13, four connection portions 110*a*, 110*b*, 110*c*, and 110*d* which correspond to each of the ink supply tubes 29*a*, 29*b*, 29*c*, and 77 are provided in the repeater 14. The ink supply tubes 29*a*, 29*b*, and 29*c* which are drawn from the first liquid storage unit 20 are connected to three connection portions 110*a*, 110*b*, and 110*c* among the connection portions. A clamp 111 is provided inside the first inlet 109 in the repeater 14. The ink supply tubes 29*a*, 29*b*, and 29*c* are respectively fixed by the clamp 111.

In addition, as illustrated in FIGS. 11 and 13, the ink supply tube 77 which is drawn to the outside of the case 71 of the second liquid storage unit 70 is guided to an opening 112 which is provided in the housing 11, and to the inside of the repeater 14 through a second inlet 113 of the repeater 14. Among the connection portions 110*a*, 110*b*, 110*c*, and 110*d* which are provided in the repeater 14, the ink supply tube 77 which is drawn from the second liquid storage unit 70 is connected to the connection portion 110*d* which is positioned at a left end in FIG. 13. The clamp 114 is provided inside the second inlet 113 in the repeater 14. The ink supply tube 77 is fixed by the clamp 114.

Next, an action of the above-described embodiment will be described.

Since the ink supply tubes 29*a*, 29*b*, 29*c*, and 77 which are provided in the printer are supported by each supporting portion, in a state where the ink supply tubes 29*a*, 29*b*, 29*c*, and 77 are arranged in the printer, it is suppressed that the ink supply tubes 29*a*, 29*b*, 29*c*, and 77 are bent and crushed.

However, only by providing each supporting portion, there is a concern that the ink supply tubes 29*a*, 29*b*, 29*c*, and 77 are arranged in a bent and crushed state from the beginning, and supported by each supporting portion as in such a bent and crushed state.

In contrast, in the embodiment, the lines 31, 32, 33, and 79 which are references of parts supported by each supporting portion are provided in the ink supply tubes 29*a*, 29*b*, 29*c*, and 77. In addition, when assembling the ink supply tubes 29*a*, 29*b*, 29*c*, and 77 to the printer, the positions thereof match the positions where the ink supply tubes 29*a*, 29*b*, 29*c*, and 77 are supported by each supporting portion by using the lines 31, 32, 33, and 79 as references. Accordingly, at an appropriate part where the ink supply tubes 29*a*, 29*b*, 29*c*, and 77 are not bent and crushed, the ink supply tubes 29*a*, 29*b*, 29*c*, and 77 are supported.

In addition, since the outer circumferential walls 52 and 87 on the outside of the curved portion are provided continuously across the entire length of the curved portion at the curved parts in each supporting portion, the ink supply tubes 29*a*, 29*b*, 29*c*, and 77 are regulated not to be projected to the outer circumferential side by the outer circumferential walls 52 and 87. Accordingly, degrees of curvature of the ink supply tubes 29*a*, 29*b*, 29*c*, and 77 are adjusted.

In addition, at the curved parts in each supporting portion, the inner circumferential walls 53 and 88 on the inside of the curved portion are provided intermittently, and at the part which is cut out by the inner circumferential walls 53 and 88, the protruding portions 54 and 86 which protrude toward the inside of the curved portion from the outer circumferential walls 52 and 87 are provided. For this reason, the ink supply tubes 29*a*, 29*b*, 29*c*, and 77 which are stored in the supporting portion are pressed by the protruding portions 54 and 86, and unlikely to be detached. In addition, since the inner circumferential walls 53 and 88 are cut out at the position where the protruding portions 54 and 86 are provided, it is possible to assemble the ink supply tubes 29*a*, 29*b*, 29*c*, and 77 to each supporting portion through the cut-out part even when the protruding portions 54 and 86 are provided.

Here, the insertion portion 45 which inserts the liquid supply needles 30 and 78 into the liquid storage body 40 is provided, but the liquid storage body 40 has irregularity in the dimension thereof due to manufacturing tolerance. For this reason, when attaching the liquid storage body 40 to each of the stays 26, 27, 28, and 76, it is desirable to match the positions of the liquid supply needles 30 and 78 and the position of the insertion portion 45 of the liquid storage body 40 by adjusting the positions of the liquid supply needles 30 and 78.

In the embodiment, since the ink supply tubes 29*a*, 29*b*, 29*c*, and 77 are supported by the first supporting portions 50*a*, 50*b*, 50*c*, and 80 to be displaceable, displacement of the liquid supply needles 30 and 78 is allowed, and adjustment of the positions of the insertion portion 45 of the liquid storage body 40 and the liquid supply needles 30 and 78 is allowed when attaching the liquid storage body 40 to each of the stays 26, 27, 28, and 76.

In addition, in the ink supply tubes 29*a*, 29*b*, and 29*c* which are connected to each of the stays 26, 27, and 28 of the first liquid storage unit 20, the plurality of lines 31, 32, and 33 are provided being apart at an interval in the extending direction of the ink supply tubes 29*a*, 29*b*, and 29*c*. For this reason, when assembling the ink supply tubes 29*a*, 29*b*, and 29*c* to the housings 11 and 21, it is possible to position the ink supply tubes 29*a*, 29*b*, and 29*c* at multiple locations.

Furthermore, since the lines 31, 32, and 33 are lines which extend along the circumferential direction of the ink supply tubes 29*a*, 29*b*, and 29*c*, it is possible to indicate a narrow range in the extending direction of the ink supply tubes 29*a*, 29*b*, and 29*c*, and more precise positioning is performed by matching the positions by using the lines as references.

In addition, the lines 31, 32, and 33 which are provided in the ink supply tubes 29*a*, 29*b*, and 29*c* are circular lines across the entire circumference of the ink supply tubes 29*a*, 29*b*, and 29*c*. For this reason, even when the ink supply tubes 29*a*, 29*b*, and 29*c* are in a twisted state, it is possible to visually recognize the lines 31, 32, and 33 which are the marks provided in the ink supply tubes 29*a*, 29*b*, and 29*c*.

In addition, in the embodiment, in the ink supply tubes 29*a*, 29*b*, and 29*c* which are connected to each of the stays 26, 27, and 28 of the first liquid storage unit 20, the first line 31 is arranged corresponding to the triangular mark 59 provided in the case 21. In addition, the second line 32 is arranged corresponding to the rib 103 of the tunnel member 100. In addition, the third line 33 is arranged corresponding to a tip end of the parallel supporting portion 107. In other words, the first line 31 and the triangular mark 59 become a pair, the second line 32 and the rib 103 become a pair, and the third line 33 and the parallel supporting portion 107 become a pair, and the ink supply tubes 29*a*, 29*b*, and 29*c* are arranged to match the positions of the marks which become a pair with each other. For this reason, a difference in supporting position becomes small, and more precise positioning of the ink supply tubes 29*a*, 29*b*, and 29*c* is performed.

In addition, since the rib 103 which is a convex portion is formed in the tunnel member 100 which is a part of the housing 11 of the recording unit 10, and the rib 103 is used as a mark which is a reference of positioning, it is possible to engrave the mark in a process of forming the housing 11, and the number of manufacturing processes is reduced compared to a case where the mark is provided after forming the housing 11.

In addition, in the ink supply tube 77 which is connected to the stay 76 of the second liquid storage unit 70, since the line 79 which extends along the circumferential direction of the ink supply tube 77 is provided, it is possible to indicate a narrow range in the extending direction of the ink supply tube 77, and more precise positioning is performed by matching the positions by using the line 79 as a reference.

Furthermore, since the line 79 which is provided in the ink supply tube 77 is a circular line across the entire circumference of the ink supply tube 77, even when the ink supply tube 77 is in a twisted state, it is possible to visually recognize the line 79 which is the mark provided in the ink supply tube 77.

In addition, in the embodiment, in the ink supply tube 77 which is connected to the stay 76 of the second liquid storage unit 70, by making the line 79 correspond to the triangular mark 90 provided in the case 71, and using these as a pair, the ink supply tube 77 is arranged so that the positions of the marks which are a pair match each other. For this reason, a difference in the supporting positions is reduced, and more precise positioning of the ink supply tube 77 is performed.

In addition, in the embodiment, the triangular marks 59 and 90 which are provided in the cases 21 and 71 of the liquid storage unit 20 and 70 are expressed by the concave/convex parts provided on the wall surfaces 25 and 75 of the cases 21 and 71. For this reason, it is possible to engrave the marks 59 and 90 in the process of forming the cases 21 and 71, and to reduce the number of manufacturing processes compared to a case where the marks 59 and 90 are provided after forming the cases 21 and 71.

According to the above-described embodiment, the following effects can be obtained.

(1) Since the lines 31, 32, 33, and 79 which are used as references of the parts supported by the supporting portion are provided in the ink supply tubes 29*a*, 29*b*, 29*c*, and 77, it is possible to suppress that the ink supply tubes 29*a*, 29*b*, 29*c*, and 77 are arranged in a bent and crushed state from the beginning. Therefore, it is possible to suppress that the ink supply tubes 29*a*, 29*b*, 29*c*, and 77 are bent and crushed by appropriately supporting the ink supply tubes 29*a*, 29*b*, 29*c*, and 77. Furthermore, it is possible to suppress that a flow of the liquid in the ink supply tubes 29*a*, 29*b*, 29*c*, and 77 deteriorates, and that printing error or the like is generated.

(2) The curved second supporting portions 51*a*, 51*b*, and 81, and the outer circumferential walls 52 and 87 of the third supporting portion 57 are provided continuously across the entire length of the curved portion. For this reason, the ink supply tubes 29*a*, 29*b*, 29*c*, and 77 are regulated not to be projected to the outer circumferential side, and it is possible to further suppress that the ink supply tubes 29*a*, 29*b*, 29*c*, and 77 are bent and crushed.

(3) The bent second supporting portions 51*a*, 51*b*, and 81, and the inner circumferential walls 53 and 88 of the third supporting portion 57 are provided intermittently, the protruding portions 54 and 86 are provided at the part which is cut out by the inner circumferential walls 53 and 88. For this reason, the ink supply tubes 29*a*, 29*b*, 29*c*, and 77 are unlikely to be detached from the supporting portion, and it is possible to assemble the ink supply tubes 29*a*, 29*b*, 29*c*, and 77 even when the protruding portions 54 and 86 are provided.

(4) The distances between the one pair of side walls in the first supporting portions 50*a*, 50*b*, 50*c*, and 80 are longer than the diameters of the ink supply tubes 29*a*, 29*b*, 29*c*, and 77, and the distances between the one pair of side walls in the second supporting portions 51*a*, 51*b*, 51*c*, and 81 are shorter than the diameters of the ink supply tubes 29*a*, 29*b*, 29*c*, and 77. For this reason, it is possible to suppress that the ink supply tubes 29*a*, 29*b*, 29*c*, and 77 are bent and crushed in the cases 21 and 71, and to adjust the positions of the insertion portion 45 of the liquid storage body 40 and the liquid supply needles 30 and 78 when attaching the liquid storage body 40 to each of the stays 26, 27, 28, and 76.

(5) Since the plurality of lines 31, 32, and 33 are provided in the ink supply tubes 29*a*, 29*b*, and 29*c*, which are connected to the stays 26, 27, and 28 of the first liquid storage unit 20, when assembling the ink supply tubes 29*a*, 29*b*, and 29*c*, it is possible to position the ink supply tubes 29*a*, 29*b*, and 29*c* at multiple locations, and to adjust the shapes thereof to be more detailed.

(6) Since the lines which are provided in the ink supply tubes 29*a*, 29*b*, 29*c*, and 77 are the lines which extend along the circumferential direction which is the direction orthogonal to the extending direction of the ink supply tubes 29*a*, 29*b*, 29*c*, and 77, by matching the positions by using the lines as the references, it is possible to more precisely position the ink supply tubes 29*a*, 29*b*, 29*c*, and 77.

(7) The lines which are provided in the ink supply tubes 29*a*, 29*b*, 29*c*, and 77 are the circular lines across the entire length of the ink supply tubes 29*a*, 29*b*, 29*c*, and 77. For this reason, it is possible to easily perform positioning by visually recognizing the lines which are the marks provided in the ink supply tubes 29*a*, 29*b*, 29*c*, and 77 even when the ink supply tubes 29*a*, 29*b*, 29*c*, and 77 are twisted.

(8) At the part where the second supporting portions 51*a*, 51*b*, 51*c*, and 81 of the cases 21 and 71 are provided, the triangular marks 59 and 90 which become a pair with the lines provided in the ink supply tubes 29*a*, 29*b*, 29*c*, and 77 are provided. For this reason, by matching the positions of the marks which become a pair with each other, it is possible to more precisely position the ink supply tubes 29*a*, 29*b*, 29*c*, and 77.

(9) Since the triangular marks 59 and 90 which are provided in the cases 21 and 71 are expressed by the concave/convex parts provided on the wall surfaces 25 and 75 of the cases 21 and 71, it is possible to engrave the marks 59 and 90 in the process of forming the cases 21 and 71, and to reduce the number of manufacturing processes compared to a case where the marks 59 and 90 are provided after forming the cases 21 and 71.

(10) Since the rib 103 which serves as a mark that becomes a pair with the line 32 that is a mark provided in the ink supply tubes 29*a*, 29*b*, and 29*c* is provided in the tunnel member 100, by matching the positions of the marks which become a pair with each other, it is possible to more precisely position the ink supply tubes 29*a*, 29*b*, and 29*c*.

(11) Since the mark provided in the tunnel member 100 is the rib 103 formed in the tunnel member 100, it is possible to provide the mark in the process of the tunnel member 100, and to reduce the number of manufacturing processes compared to a case where the mark is provided after forming the tunnel member 100.

In addition, the above-described embodiment can be changed and realized as follows.

The plurality of marks may be provided being apart at an interval in the extending direction in the ink supply tube 77 which is connected to the stay 76 of the second liquid storage unit 70. In this case, the ink supply tube 77 may be assembled to each of the supporting portions 80, 81, and 89 by making the marks and one end of each of the supporting portions 80, 81, and 89 correspond to each other.

When the plurality of marks are provided in the ink supply tubes 29*a*, 29*b*, 29*c*, and 77, marks which are different from each other may be used. For example, colors, shapes, or design of the marks may be different from each other.

The triangular marks may be engraved as concave portions in the cases 21 and 71.

An example in which the marks are expressed by the concave/convex parts provided on the wall surfaces 25 and 75 is described, but since a mark of which a position can be confirmed may be employed, it is possible to express the mark in another method. For example, a configuration in which a mark is drawn by paint, or a configuration in which a component which is a sign as a mark is attached, can be employed.

The marks provided in the cases 21 and 71 may be colored. In this case, by making the colors of each mark different from each other, the colors of the marks in the ink supply tubes 29*a*, 29*b*, 29*c*, and 77 may correspond to the same colors as the colors of the marks provided in the cases. According to this configuration, it is easier to understand correspondence between the marks provided in the ink supply tubes 29*a*, 29*b*, 29*c*, and 77 and the marks provided in the cases.

A mark may be provided at a part other than the part where the second supporting portions 51*a*, 51*b*, 51*c*, and 81 of the cases 21 and 71 are provided. For example, a mark may be provided at a part where the first supporting portions 50*a*, 50*b*, 50*c*, and 80 are provided, or at a part where the third supporting portions 57 and 89 are provided.

The mark provided in the cases 21 and 71 may have a shape other than a triangular shape. For example, a line, a circle, a square, or other symbols may be employed.

Three liquid storage bodies 40 are stored in the first liquid storage unit 20, and one liquid storage body 40 is stored in the second liquid storage unit 70, but the number of the liquid storage bodies 40 may be appropriately changed. In addition, at least only one of the first liquid storage unit 20 and the second liquid storage unit 70 may be provided.

In each supporting portion, the number of protruding portions 54 and 86 may be appropriately changed.

The number of supporting portions which are provided in the case 21 of the first liquid storage unit 20 may be appropriately changed.

The number of supporting portions which are provided in the case 71 of the second liquid storage unit 70 may be appropriately changed.

A mark which is different from the rib 103 may be formed in the tunnel member 100. Since a mark of which a position can be confirmed may be employed, for example, a groove which extends in the vertical direction may be formed. In addition, a configuration in which a mark is drawn by paint, or a configuration in which a component which is a sign as a mark is attached, can be employed. In addition, the tunnel member 100 and the rib 103 may be separately molded and fixed by performing adhering or the like.

In the board portion 106 of the housing 11 of the recording unit 10, the mark which becomes a pair with the third line 33 provided in the ink supply tubes 29*a*, 29*b*, and 29*c* at the part where the parallel supporting portion 107 is provided, for example, a mark which indicates a part where one end of the parallel supporting portion 107 is positioned may be provided. According to this configuration, by matching the positions of the marks which become a pair with each other, it is possible to more precisely position the ink supply tubes 29*a*, 29*b*, and 29*c*. In addition, in this configuration, when the mark provided in the housing 11 is expressed by the concave/convex parts provided on the wall surface of the board portion 106, since it is possible to engrave the mark in the process of forming the housing 11, it is possible to reduce the number of manufacturing processes compared to a case where the mark is provided after forming the housing 11.

The triangular marks may not be provided in the cases 21 and 71. Even in this case, the ink supply tubes 29*a*, 29*b*, 29*c*, and 77 are assembled so that the lines 31 and 79 match one end of the second supporting portions 51*a*, 51*b*, 51*c*, and 81. Accordingly, it is possible to support the ink supply tubes 29*a*, 29*b*, 29*c*, and 77 at an appropriate part where the ink supply tubes 29*a*, 29*b*, 29*c*, and 77 are not bent and crushed.

The lines 31, 32, 33, and 79 provided in the ink supply tubes 29*a*, 29*b*, 29*c*, and 77 may not be the circular lines across the entire circumference. For example, the lines 31, 32, 33, and 79 which extend in the circumferential direction may be provided intermittently, for example, a part in the circumferential direction is cut out.

Other symbols except for the line which serves as the mark provided in the ink supply tubes 29*a*, 29*b*, 29*c*, and 77 may be used. For example, a circular or a triangular symbol may be used.

The number of marks provided in the ink supply tubes 29*a*, 29*b*, and 29*c* may be appropriately changed if the number is 1 or more.

The distances between the one pair of side walls in the first supporting portions 50*a*, 50*b*, 50*c*, and 80 may be the same as the diameters of the ink supply tubes 29*a*, 29*b*, 29*c*, and 77, and may be shorter than the diameters of the ink supply tubes 29*a*, 29*b*, 29*c*, and 77.

The protruding portions 54 and 86 are provided in each supporting portion, but the protruding portions 54 and 86 may not be provided. In this case, it is not necessary to intermittently provide the inner circumferential walls 53 and 88, or the upper walls 56 and 85.

The outer circumferential walls 52 and 87 or the lower walls 55 and 84 may be provided intermittently. For example, when the length of the cut-out part is shorter than the diameters of the ink supply tubes 29*a*, 29*b*, 29*c*, and 77, it is not necessary to intermittently provide the outer circumferential walls 52 and 87 or the lower walls 55 and 84.

When the liquid storage body 40 is empty, a replaceable type which replaces the liquid storage body 40 with the new liquid storage body 40 which is fully filled with the ink may be employed, or an injection type which injects the ink into the empty liquid storage body may be employed.

The liquid storage units 20 and 70 may be provided in the recording unit 10. In this case, the liquid storage body 40 which is stored in the liquid storage units 20 and 70 is also provided inside the recording unit 10.

In the above-described embodiment, the recording apparatus may be a liquid ejecting apparatus which performs recording by ejecting or discharging liquid other than the ink. For example, the recording apparatus may be a liquid body ejecting apparatus which performs recording by ejecting a liquid body that includes a dispersed or dissolved material, such as an electrode material or a coloring material (pixel material), which is used in manufacturing a liquid-crystal display, an electroluminescence (EL) display, and a surface light emission display. In addition, the recording apparatus may be a fluid ejecting apparatus which ejects a fluid, such as gel (for example, physical gel).

The entire disclosure of Japanese Patent Application No. 2014-155906, filed Jul. 31, 2014 is expressly incorporated by reference herein.

What is claimed is:

1. A recording apparatus, comprising:

a recording head which performs recording by ejecting liquid onto a recording medium;

a recording unit which stores the recording head;

a storage unit which is provided outside the recording unit, and stores a liquid storage body that stores the liquid to be ejected from the recording head;

a liquid supply tube which supplies the liquid that is stored in the liquid storage body stored in the storage unit to the recording head; and a supporting portion which is provided in at least one of the recording unit and the storage unit, and supports the liquid supply tube, wherein a mark which is a reference of a part supported by the supporting portion is provided in the liquid supply tube.

2. The recording apparatus according to claim 1, wherein the supporting portion includes a guide groove which stores the liquid supply tube, and wherein, in the guide groove, an outer circumferential wall on the outside of a curved portion on a curved part is provided continuously across the entire length of the curved portion of the guide groove.

3. The recording apparatus according to claim 2, wherein, in the guide groove, an inner circumferential wall on the inside of the curved portion on a curved part is provided intermittently, and wherein, at a part where the inner circumferential wall in the guide groove is cut out, a protruding portion which protrudes toward the inside of the curved portion from the outer circumferential wall, and presses the liquid supply tube stored in the guide groove is provided.

4. The recording apparatus according to claim 1, wherein a supporting mechanism to which the liquid storage body is attached is fixed in the storage unit, wherein, in the supporting mechanism, a liquid supply needle which is inserted into the liquid storage body and makes the liquid storage body and the liquid supply tube communicate with each other when the liquid storage body is attached is provided, wherein, as the supporting portion, while a first supporting portion is provided at a part where the liquid supply tube is drawn out from the supporting mechanism in the storage unit, a second supporting portion is provided at a position which is separated from the first supporting portion in the case, and wherein one pair of side walls are respectively provided in the first supporting portion and the second supporting portion, a distance between the one pair of side walls in the first supporting portion is longer than a diameter of the liquid supply tube, and a distance between the one pair of side walls in the second supporting portion is shorter than the diameter of the liquid supply tube.

5. The recording apparatus according to claim 1, wherein, at a part where the supporting portion in the storage unit is provided, a mark which becomes a pair with the mark provided in the liquid supply tube is provided.

6. The recording apparatus according to claim 5, wherein the mark which is provided in the storage unit is expressed by a concave/convex part provided on a wall surface of the storage unit.

7. The recording apparatus according to claim 1, wherein, at a part where the supporting portion in the recording unit is provided, a mark which becomes a pair with the mark provided in the liquid supply tube is provided.

8. The recording apparatus according to claim 7, wherein the mark which is provided in the recording unit is expressed by a concave/convex part provided on a wall surface of the recording unit.

9. The recording apparatus according to claim 1, wherein the plurality of liquid storage bodies are stored in the liquid storage unit.

10. The recording apparatus according to claim 1, wherein an opening is provided in the recording unit, and the liquid supply tube which is supported by the supporting portion is guided to the inside of the recording unit from the inside of the storage unit through the opening.

11. A recording apparatus, comprising:

a recording head which performs recording by ejecting liquid onto a recording medium;

a recording unit which stores the recording head;

a storage unit which stores a liquid storage body that stores the liquid to be ejected from the recording head;

a liquid supply tube which supplies the liquid that is stored in the liquid storage body stored in the storage unit to the recording head; and a supporting portion which is provided in at least one of the recording unit and the storage unit, and supports the liquid supply tube, wherein a mark which is a reference of a part supported by the supporting portion is provided in the liquid supply tube.

12. The recording apparatus according to claim 11, wherein the supporting portion includes a guide groove which stores the liquid supply tube, and wherein, in the guide groove, an outer circumferential wall on the outside of a curved portion on a curved part is provided continuously across the entire length of the curved portion of the guide groove.

13. The recording apparatus according to claim 12, wherein, in the guide groove, an inner circumferential wall on the inside of the curved portion on a curved part is provided intermittently, and wherein, at a part where the inner circumferential wall in the guide groove is cut out, a protruding portion which protrudes toward the inside of the curved portion from the outer circumferential wall, and presses the liquid supply tube stored in the guide groove is provided.

14. The recording apparatus according to claim 11, wherein a supporting mechanism to which the liquid storage body is attached is fixed in the storage unit, wherein, in the supporting mechanism, a liquid supply needle which is inserted into the liquid storage body and makes the liquid storage body and the liquid supply tube communicate with each other when the liquid storage body is attached is provided, wherein, as the supporting portion, while a first supporting portion is provided at a part where the liquid supply tube is drawn out from the supporting mechanism in the storage unit, a second supporting portion is provided at a position which is separated from the first supporting portion in the case, and wherein one pair of side walls are respectively provided in the first supporting portion and the second supporting portion, a distance between the one pair of side walls in the first supporting portion is longer than a diameter of the liquid supply tube, and a distance between the one pair of side walls in the second supporting portion is shorter than the diameter of the liquid supply tube.

15. The recording apparatus according to claim 11, wherein, at a part where the supporting portion in the storage unit is provided, a mark which becomes a pair with the mark provided in the liquid supply tube is provided.

16. The recording apparatus according to claim 15, wherein the mark which is provided in the storage unit is expressed by a concave/convex part provided on a wall surface of the storage unit.

17. The recording apparatus according to claim 11, wherein, at a part where the supporting portion in the recording unit is provided, a mark which becomes a pair with the mark provided in the liquid supply tube is provided.

18. The recording apparatus according to claim 17, wherein the mark which is provided in the recording unit is expressed by a concave/convex part provided on a wall surface of the recording unit.

19. The recording apparatus according to claim 11, wherein the plurality of liquid storage bodies are stored in the liquid storage unit.

* * * * *